US011674332B1

(12) United States Patent
Santiago

(10) Patent No.: US 11,674,332 B1
(45) Date of Patent: Jun. 13, 2023

(54) KEY HOLE COVER

(71) Applicant: Wilfredo Santiago, Manchester, NH (US)

(72) Inventor: Wilfredo Santiago, Manchester, NH (US)

( * ) Notice: Subject to any disclaimer, the term of this patent is extended or adjusted under 35 U.S.C. 154(b) by 59 days.

(21) Appl. No.: 17/005,654

(22) Filed: Aug. 28, 2020

(51) Int. Cl.
*E05B 17/18* (2006.01)
*E05B 77/34* (2014.01)
*E05B 17/00* (2006.01)

(52) U.S. Cl.
CPC ..... *E05B 17/188* (2013.01); *E05B 17/002* (2013.01); *E05B 17/18* (2013.01); *E05B 77/34* (2013.01)

(58) Field of Classification Search
CPC ..... E05B 17/002; E05B 17/14; E05B 17/18; E05B 17/183; E05B 17/185; E05B 17/188; E05B 77/34
See application file for complete search history.

(56) References Cited

U.S. PATENT DOCUMENTS 2,261,472 A 11/1941 Hurd
2,439,978 A 4/1948 Konchan
2,585,331 A 2/1952 King
2,617,290 A 11/1952 Schwartz
2,931,209 A 4/1960 Dies et al.
3,434,318 A 3/1969 Thiry
3,861,182 A 1/1975 Skinner
4,154,072 A * 5/1979 Flaschar ..... E05B 17/183 70/455
4,706,841 A * 11/1987 Grajek ..... E05B 17/14 220/375
4,709,567 A * 12/1987 Appelbaum ..... E05B 17/183 70/455
4,825,673 A 5/1989 Drake
4,858,454 A 8/1989 McAnulty, III
5,109,686 A * 5/1992 Toussant ..... E05B 17/183 70/454
5,241,846 A * 9/1993 Hoke ..... E05B 17/183 70/423
5,615,567 A 4/1997 Kemp
5,718,137 A * 2/1998 Huston ..... E05B 17/185 70/423
5,746,078 A 5/1998 Kiernan
10,612,270 B1 * 4/2020 Wu ..... E05B 17/183
2008/0314103 A1 12/2008 Corlija

* cited by examiner

*Primary Examiner* — Christopher J Boswell
(74) *Attorney, Agent, or Firm* — Lorusso & Associates

(57) ABSTRACT

A vehicle lock assembly key hole cover having a flat or ovoid surface with an annular shoulder extending axially from the surface. The annular shoulder is formed with one of several features including a taper in cross-section, geometrically-shaped slots and elastomeric inserts to impart flexibility to the shoulder. An elastomeric sealing ring may be secured to an inner surface of the shoulder to create a seal and increase adhesion to a lock assembly. An adhesive patch may be used to enhance adhesion to a lock assembly.

20 Claims, 10 Drawing Sheets

KEY HOLE COVER

CROSS-REFERENCE TO RELATED APPLICATIONS

None.

FIELD OF THE DISCLOSURE

The disclosure relates generally to apparatus for covering openings in mechanical devices. More particularly, the disclosure concerns covers for key holes and more specifically, vehicle lock assembly key holes.

BACKGROUND OF THE DISCLOSURE

Many modern vehicles are designed with keyless entries. There still remain, however, vehicles designed with locks having key holes that require a key to open the lock. Although such locks have retractable hole covers, the configurations are notorious for permitting the entry of water, which can lead to enclosed tumbler assemblies rusting to the point of malfunction. The problem is one that has existed for as long as there have been vehicles with locks. Several solutions have been innovated over the decades, each with significant limitations.

One such innovation is disclosed in U.S. Pat. No. 5,615,567 in which the lock cover comprises a flexible, elastomeric-like sleeve. Although the sleeve performs the intended function, it is made from a relatively flimsy outer material that can degrade due to constant exposure to weather. A central layer made from neoprene is surrounded by a nylon material. The nylon material, as is well known in the art, can be easily cut and frayed with continual use. Exposure to ultraviolet light can further degrade the material. What is needed is a simplified keyhole cover that does not require any articulating component combinations and is impervious to weather conditions. What is further needed is a cover that is easily secured to an exposed key lock and easily removed without the need for any hand manipulated tools. These and other objects of the disclosure will become apparent from a reading of the following summary and detailed description of the disclosure. These and other objects of the disclosure will become apparent from a review of the following drawings and a review of the detailed disclosure.

SUMMARY OF THE DISCLOSURE

In one aspect of the disclosure, a keyhole cover includes a smooth round surface, flat or ovoid in cross-section, with a top surface and an annular shoulder extending axially from a perimeter of the top surface. The annular shoulder is formed with a taper in cross-section with a thicker first end of the taper formed proximal to the top surface and a thinner second end formed distal from the top surface. The thickness of the second end permits the radially extension of the end to permit the end to be superposed about a perimeter of a key lock face.

In another aspect of the disclosure, a keyhole cover includes a smooth round surface, flat or ovoid in cross-section, with a top surface and an annular shoulder formed with a flexible construction with alternating segments having varying thicknesses to permit the radial flexion of the shoulder so as to permit the shoulder to be superposed about, or removed from, a perimeter of a key lock face plate.

In a still further aspect of the disclosure, a keyhole cover includes a smooth, round surface, flat or ovoid in cross-section, with an annular shoulder extending axially from the round surface and formed with expansion slots to permit the shoulder to expand and be superposed about, or removed from, a perimeter edge of a keylock face plate.

In yet another aspect of the disclosure, a keyhole cover includes a smooth, round surface, flat or ovoid in cross-section, with an annular shoulder extending axially from the round surface. A disc with a mildly aggressive adhesive is positioned on an inner face of the round surface to promote adhesion of the cover to the portions of a lock assembly defining a keyhole. The adhesive ensures the cover remains over the lock assembly, but permits removal of the cover with finger pressure.

In another aspect of the disclosure, a keyhole cover includes a smooth, round surface, flat or ovoid in cross-section, with an annular shoulder extending axially from the round surface. A keyhole slot is formed in the cover to align with the keyhole in a lock assembly. The keyhole slot may be formed with a retractable hole cover.

In a still further aspect of the disclosure, a keyhole cover includes a smooth, round surface, flat or ovoid in cross-section, with an annular shoulder extending axially from the round surface. An inner surface of the annular shoulder is formed with at least one vertical groove to provide a weakened zone that permits the annular shoulder to be flexed onto or off a lock assembly.

In yet another aspect of the disclosure, a keyhole cover includes a smooth, round surface, flat or ovoid in cross-section, with an annular shoulder extending axially from the round surface. An inner surface of the annular shoulder is formed with three spaced vertical grooves that provide a weakened zone that flexes like folds to facilitate the placement and removal of the keyhole cover with finger pressure.

In another embodiment of the disclosure, a keyhole cover includes a smooth, round surface, flat or ovoid in cross-section, with an annular shoulder extending axially from the round surface. An elastomeric insert is placed in a slot formed in the annular shoulder to facilitate the placement on, and removal of, the keyhole cover from a lock assembly.

In a further embodiment of the disclosure, a keyhole cover includes a smooth, round surface, flat or ovoid in cross-section, with an annular shoulder extending axially from the round surface. An annular recessed channel is formed on a distal end of the shoulder to receive a sealing gasket secured between a vehicle door panel and a lock assembly. An elastomeric annular ring is secured to an inner wall of the shoulder, adjacent the channel, to provide a gripping surface for the lock assembly.

In a still further embodiment of the disclosure, a keyhole cover includes a smooth, round surface, flat or ovoid in cross-section, with an annular shoulder extending axially from the round surface. An elastomeric annular ring is secured to an inner wall of the shoulder to provide a gripping surface for the lock assembly. These and other aspects of the disclosure will become apparent from a review of the appended drawings and a reading of the following detailed description of the disclosure.

DETAILED DESCRIPTION OF THE DISCLOSURE

Figure 1:
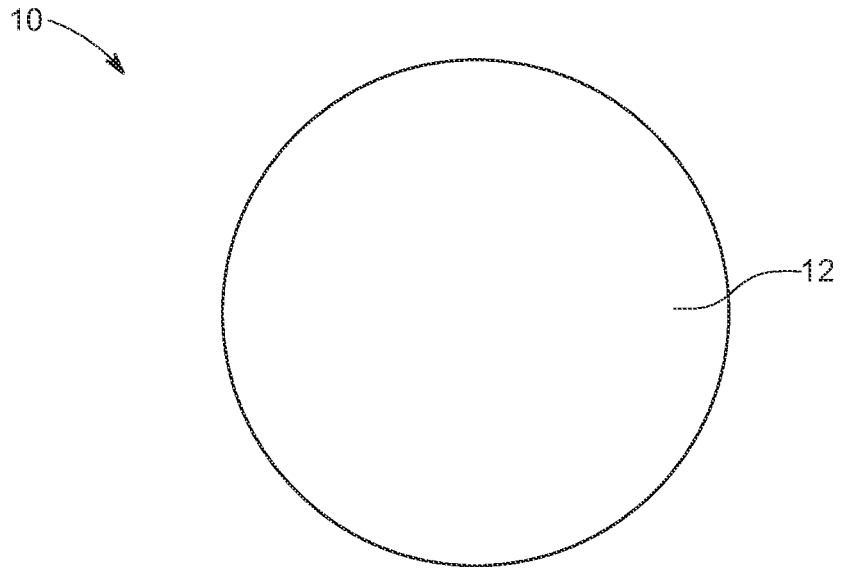
FIG. 1 is a top plan view of a keyhole cover according to one embodiment of the disclosure.
Figure 2:
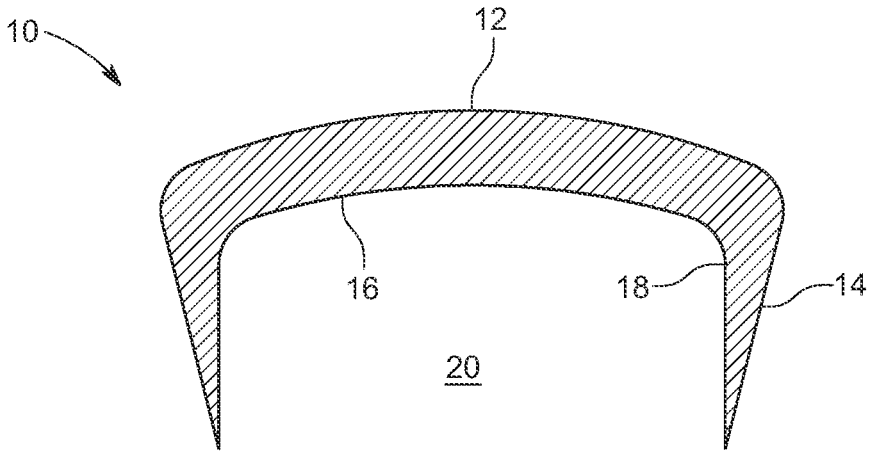
FIG. 2 is a side, sectional view in elevation of the keyhole cover shown in FIG. 1.

In one aspect of the disclosure, as shown in FIGS. 1 and 2, a vehicle lock assembly keyhole slot cover, designated generally as 10, includes a flat or ovoid-shaped top surface 12 and an annular shoulder 14 extending from an inner face 16 of the top surface 12. The combination of the bottom face 16 and an inner surface 18 of the annular shoulder 14 forms a cavity 20 dimensioned to receive the exposed surfaces of a vehicle lock assembly including a keyhole slot found particularly in late model Jeep brand vehicles. Annular shoulder 14 is formed with a taper in cross section with the larger end of the taper positioned proximal the top surface 12. By reducing the thickness of the shoulder at a distal end, the shoulder is able to flex outwardly. Material memory flexes the shoulder back to the unstressed, unflexed position. The circumference of the bottom opening defined by the annular shoulder is dimensioned to be slightly smaller than the circumference of the exposed surfaces of the lock assembly so a tight friction fit is achieved when the cover is secured over the lock assembly.

Figure 3:
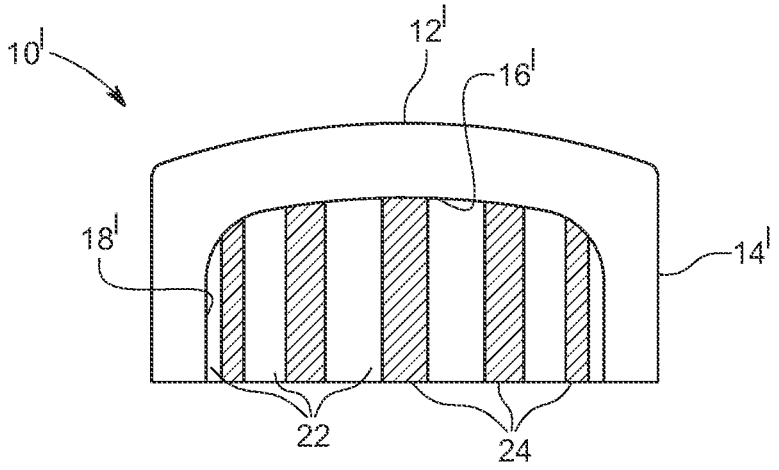
FIG. 3 is a side, sectional view in elevation of a keyhole cover according to another embodiment of the disclosure.
Figure 4:
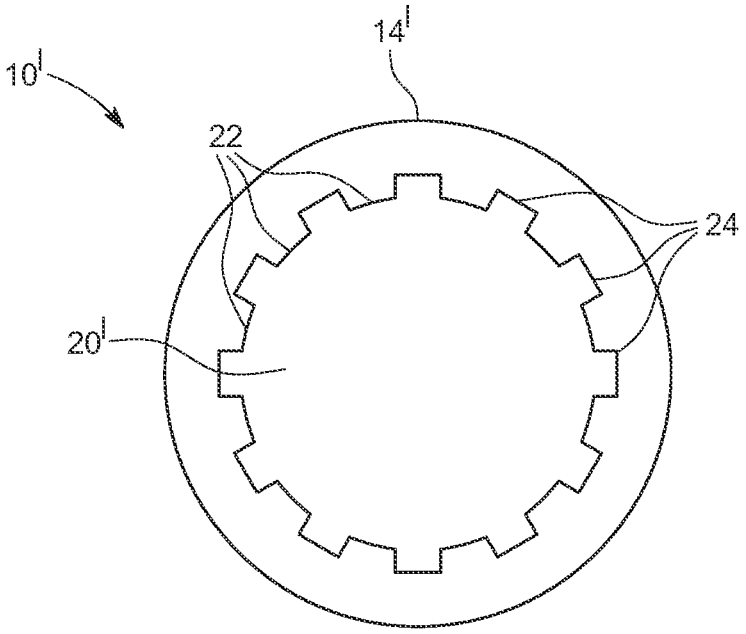
FIG. 4 is a bottom view of the keyhole cover shown in FIG. 3.
Figure 5:
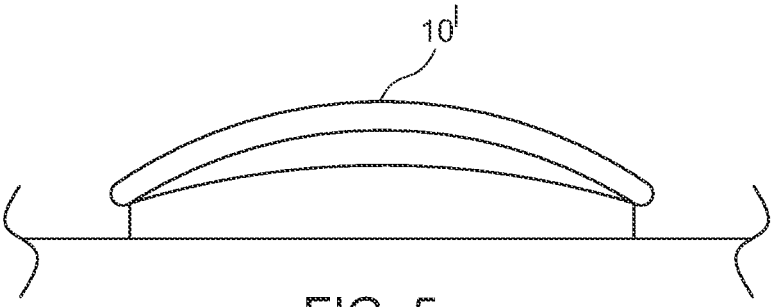
FIG. 5 is a side, sectional view in elevation of the keyhole cover shown in FIGS. 3 and 4 assembled to a key assembly.

Referring now to FIGS. 3 and 4, in another aspect of the disclosure, a vehicle lock assembly keyhole slot cover, designated generally as 10', includes a flat or ovoid-shaped top surface 12' and an annular shoulder 14' extending from an inner face of the top surface 12'. The combination of a bottom face of the top surface and an inner surface 18' of the annular shoulder 14' forms a cavity 20' dimensioned to receive the exposed surfaces of a vehicle lock assembly including a keyhole slot found particularly in late model Jeep brand vehicles. Annular shoulder 14' is formed with a series of alternating thick segments 22 and thin segments 24 in an alternating pattern to permit shoulder 14' to flex outwardly. Material memory flexes the shoulder back to the unstressed, unflexed position. The circumference of the bottom opening defined by the thick segments 22 of annular shoulder 14' is dimensioned to be slightly smaller than the circumference of the exposed surfaces of the lock assembly so a tight friction fit is achieved when the cover is secured over the lock assembly as shown in FIG. 5.

Figure 6:
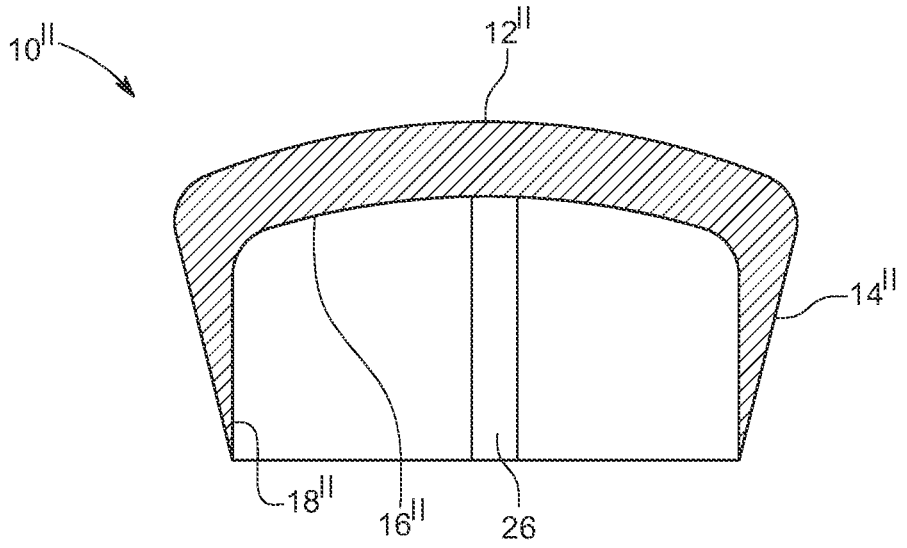
FIG. 6 is a side, sectional view in elevation of a keyhole cover according to a further embodiment of the disclosure.
Figure 7:
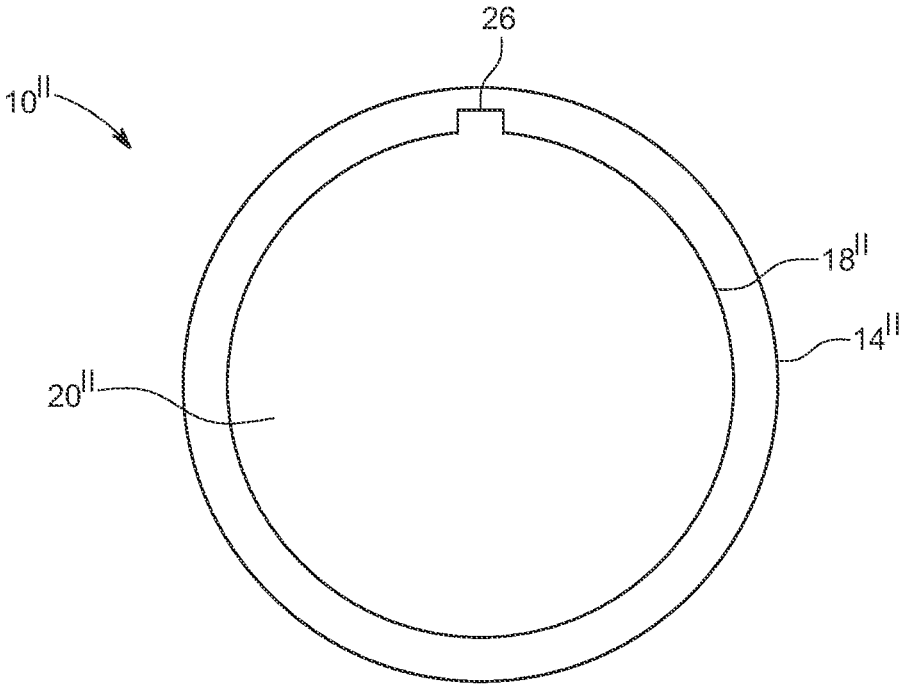
FIG. 7 is a bottom view of the keyhole cover shown in FIG. 6.

Referring now to FIGS. 6 and 7, in yet another aspect of the disclosure, a vehicle lock assembly keyhole slot cover, designated generally as 10", includes a flat or ovoid-shaped top surface 12" and an annular shoulder 14" extending from an inner face of the top surface 12". The combination of a bottom face 16" of the top surface and an inner surface 18" of the annular shoulder 14" forms a cavity 20" dimensioned to receive the exposed surfaces of a vehicle lock assembly including a keyhole slot found particularly in late model Jeep® brand vehicles, and particularly the Jeep Wrangler model vehicles. Annular shoulder 14" is formed with a reduced-thickness slot 26 that forms a weakened zone in the shoulder to permit the shoulder to be stretched with the application of finger pressure at the point of slot 26. It should be understood that the width of slot 26 may be varied to accommodate the resiliency of the material used to make the keyhole cover.

Annular shoulder 14" also may be formed with a taper in cross section as shown and described for the embodiment shown in FIG. 2 to facilitate the flexibility of the distal end of the shoulder. The reduced-thickness section flexes outwardly with the application of pressure. Material memory flexes the shoulder back to the unstressed, unflexed position. The circumference of the bottom opening defined by inner surface 18" dimensioned to be slightly smaller than the circumference of the exposed surfaces of the lock assembly so a tight friction fit is achieved when the cover is secured over the lock assembly.

Figure 8:
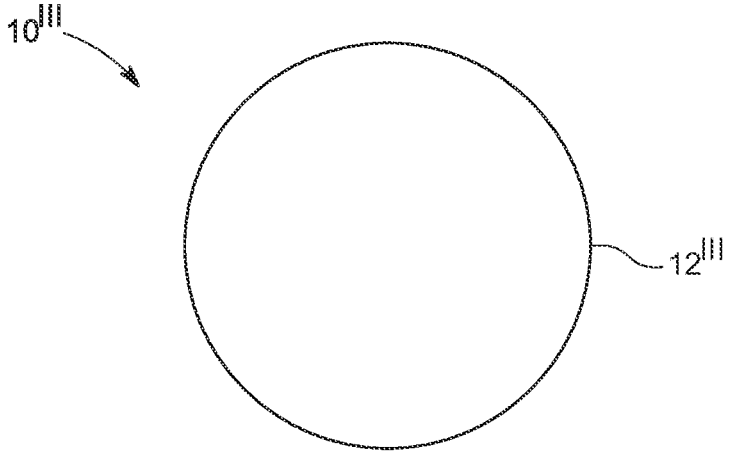
FIG. 8 is top view of a keyhole cover according to a yet further embodiment of the disclosure.
Figure 9:
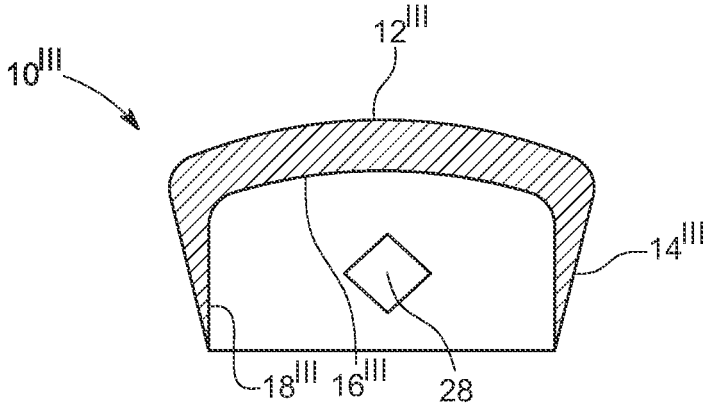
FIG. 9 is a side, sectional view in elevation of the keyhole cover with a diamond-shaped shoulder slot shown in FIG. 8.

Referring now to FIGS. 8 and 9, in another aspect of the disclosure, a vehicle lock assembly keyhole slot cover, designated generally as 10''', includes a flat or ovoid-shaped top surface 12''' and an annular shoulder 14''' extending from an inner face of the top surface 12'''. The combination of a bottom face 16''' of the top surface and an inner surface 18''' of the annular shoulder 14''' forms a cavity 20''' dimensioned to receive the exposed surfaces of a vehicle lock assembly including a keyhole slot found particularly in late model Jeep brand vehicles. Annular shoulder 14''' is formed with a diamond-shaped slot 28 in an alternating pattern to permit shoulder 14''' to flex outwardly. Slot 28 essentially permits shoulder 14''' to distort around the area of the slot to permit finger pressure to flex the shoulder outwardly. Material memory flexes the shoulder back to the unstressed, unflexed position that returns the slot to its original shape. It should be understood slot 28 may conform to any regular or irregular geometric shape and remain with the scope and spirit of the disclosure and appended claims. The circumference of the bottom opening defined inner surface 18''' is dimensioned to be slightly smaller than the circumference of the exposed surfaces of the lock assembly so a tight friction fit is achieved when the cover is secured over the lock assembly.

Figure 10:
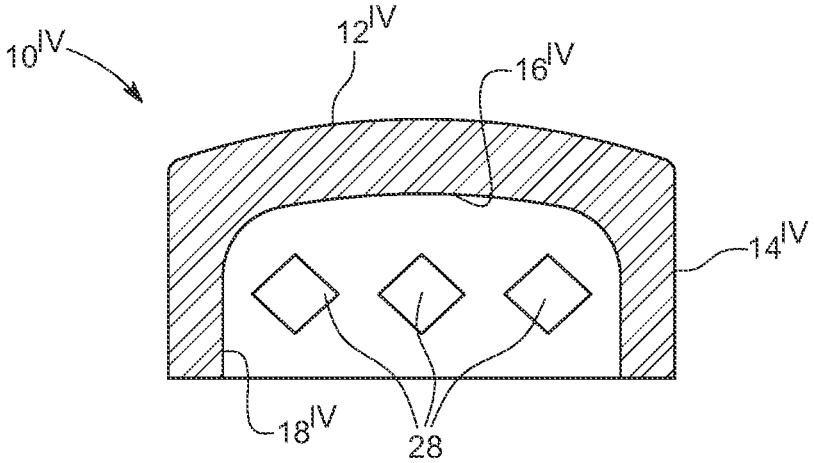
FIG. 10 a side, sectional view in elevation of a keyhole cover with a plurality of diamond-shaped shoulder slots according to a still further embodiment of the disclosure.

Referring now to FIG. 10, a key slot cover shown designated generally as $\mathbf{10}^{IV}$ has all the same features as the embodiment shown in FIGS. 8 and 9 with the addition of a plurality of diamond-shaped slots 28. Keyhole slot cover $\mathbf{10}^{IV}$, includes a flat or ovoid-shaped top surface $\mathbf{12}^{IV}$ and an annular shoulder $\mathbf{14}^{IV}$ extending from an inner face of the top surface $\mathbf{12}^{IV}$. The combination of a bottom face $\mathbf{16}^{IV}$ of the top surface and an inner surface $\mathbf{18}^{IV}$ of the annular shoulder $\mathbf{14}^{IV}$ forms a cavity $\mathbf{20}^{IV}$ dimensioned to receive the exposed surfaces of a vehicle lock assembly including a keyhole slot found particularly in late model Jeep brand vehicles. Annular shoulder $\mathbf{14}^{IV}$ is formed with a plurality of diamond-shaped slots 28 to provide a more flexible shoulder $\mathbf{14}^{IV}$ than provided by the embodiment shown in FIGS. 8 and 9. Like the prior embodiment, the application of pressure at any area of shoulder $\mathbf{14}^{IV}$ formed with slots 28 will distort the slots and permit the flexion of shoulder $\mathbf{14}^{IV}$ outwardly. Material memory flexes the shoulder back to the unstressed, unflexed position and the return of the diamond-shaped slots to their original shape. The circumference of the bottom opening defined by inner face $\mathbf{18}^{IV}$ is dimensioned to be slightly smaller than the circumference of the exposed surfaces of the lock assembly so a tight friction fit is achieved when the cover is secured over the lock assembly.

Figure 11:
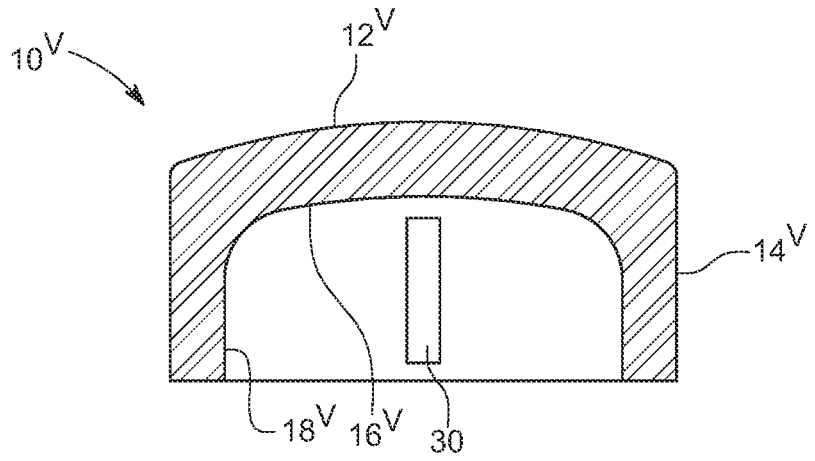
FIG. 11 is a side, sectional view in elevation of a keyhole cover with a rectangular shoulder slot according to another embodiment of the disclosure.

Referring now to FIG. 11, a key slot cover shown designated generally as $\mathbf{10}^{V}$ has all the same features as the embodiment shown in FIGS. 8 and 9 with the modification of a rectangular slot 30 for the diamond-shaped slot 28. Keyhole slot cover $\mathbf{10}^{V}$, includes a flat or ovoid-shaped top surface $\mathbf{12}^{V}$ and an annular shoulder $\mathbf{14}^{V}$ extending from an inner face of the top surface $\mathbf{12}^{V}$. The combination of a bottom face $\mathbf{16}^{V}$ of the top surface and an inner surface $\mathbf{18}^{V}$ of the annular shoulder $\mathbf{14}^{V}$ forms a cavity $\mathbf{20}^{V}$ dimensioned to receive the exposed surfaces of a vehicle lock assembly including a keyhole slot found particularly in late model Jeep brand vehicles. Annular shoulder $\mathbf{14}^{V}$ is formed with a rectangular shoulder slot 30 to provide a flexion point for shoulder $\mathbf{14}^{V}$. Like the prior shoulder slot embodiments, the application of pressure on shoulder $\mathbf{14}^{V}$ at slot 30 will distort the slot and permit the flexion of shoulder $\mathbf{14}^{V}$ outwardly. Material memory flexes the shoulder back to the unstressed, unflexed position and the return of the rectangular-shaped slot 30 to its original shape. The circumference of the bottom opening defined by inner face $\mathbf{18}^{V}$ is dimensioned to be slightly smaller than the circumference of the exposed surfaces of the lock assembly so a tight friction fit is achieved when the cover is secured over the lock assembly.

Figure 12:
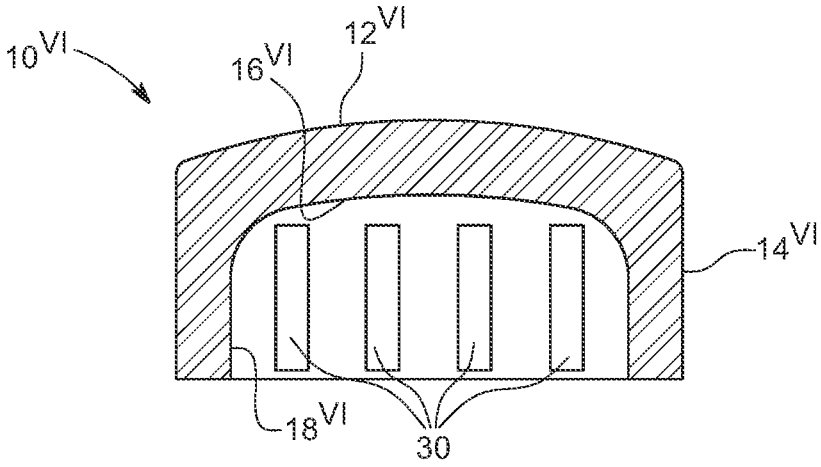
FIG. 12 is side, sectional view in elevation of a keyhole cover with a plurality of rectangular shoulder slots according to yet another embodiment of the disclosure.

Referring now to FIG. 12, a key slot cover shown designated generally as $\mathbf{10}^{VI}$ has all the same features as the embodiment shown in FIG. 11 with the addition of a plurality of rectangular slots 30. Keyhole slot cover $\mathbf{10}^{VI}$, includes a flat or ovoid-shaped top surface $\mathbf{12}^{VI}$ and an annular shoulder $\mathbf{14}^{VI}$ extending from an inner face of the top surface $\mathbf{12}^{VI}$. The combination of a bottom face $\mathbf{16}^{VI}$ of the top surface and an inner surface $\mathbf{18}^{VI}$ of the annular shoulder $\mathbf{14}^{VI}$ forms a cavity $\mathbf{20}^{VI}$ dimensioned to receive the exposed surfaces of a vehicle lock assembly including a keyhole slot found particularly in late model Jeep brand vehicles. Annular shoulder $\mathbf{14}^{VI}$ is formed with a plurality of rectangular slots 30 to provide a more flexible shoulder $\mathbf{14}^{VI}$ than provided by the embodiment shown in FIG. 11. Like the prior embodiment, the application of pressure at any area of shoulder $\mathbf{14}^{VI}$ formed with slots 30 will distort the slots and permit the flexion of shoulder $\mathbf{14}^{VI}$ outwardly. Material memory flexes the shoulder back to the unstressed, unflexed position and the return of the rectangular-shaped slots to their original shape. The circumference of the bottom opening defined by inner face $\mathbf{18}^{VI}$ is dimensioned to be slightly smaller than the circumference of the exposed surfaces of the lock assembly so a tight friction fit is achieved when the cover is secured over the lock assembly.

Figure 13:
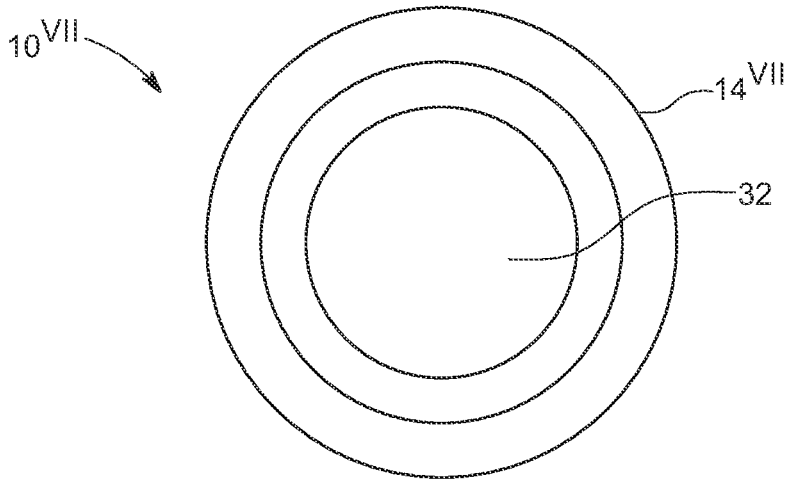
FIG. 13 is a bottom view of a keyhole cover with an adhesive-backed patch according to a further embodiment of the disclosure.
Figure 14:
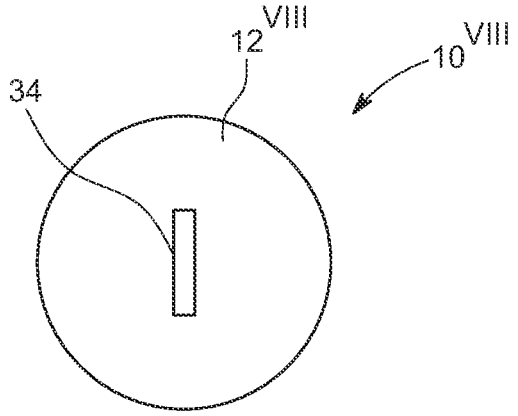
FIG. 14 is a top view of a keyhole cover with a key slot according to yet another embodiment of the disclosure.
Figure 15:
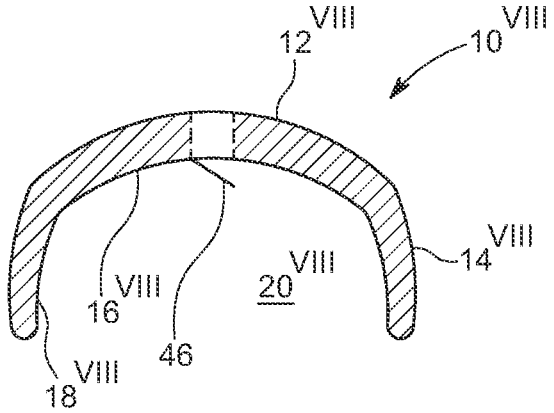
FIG. 15 is a side, sectional view in elevation of a keyhole cover with a key slot and retractable key slot cover according to a further embodiment of the disclosure.

Referring now to FIG. 13, in another aspect of the disclosure, a key slot cover shown designated generally as $\mathbf{10}^{VII}$ has all the same features as the embodiment shown in FIGS. 1 and 2 with the addition of an adhesive-backed patch 32. Keyhole slot cover $\mathbf{10}^{VII}$ includes a flat or ovoid-shaped top surface $\mathbf{12}^{VII}$ and an annular shoulder $\mathbf{14}^{VII}$ extending from an inner face of the top surface $\mathbf{12}^{VII}$. The combination of a bottom face $\mathbf{16}^{VII}$ of the top surface and an inner surface $\mathbf{18}^{VII}$ of the annular shoulder $\mathbf{14}^{VII}$ forms a cavity $\mathbf{20}^{VII}$ dimensioned to receive the exposed surfaces of a vehicle lock assembly including a keyhole slot found particularly in late model Jeep brand vehicles. Patch 32 is constructed from foam or similar material to prevent marring of the lock assembly face surfaces. An aggressive, permanent adhesive is applied to the face of patch 32 registered against bottom face $\mathbf{16}^{VII}$ A less aggressive adhesive such as the acrylic-based adhesive used on Post-it® notes is applied to the downwardly facing surface of patch 30. When key hole cover $\mathbf{10}^{VII}$ is secured to a lock assembly, the less aggressive adhesive will ensure the cover remains on the lock assembly, but permits removal of the cover without the need to use anything other than finger pressure. Like the other embodiments, annular shoulder $\mathbf{14}^{VII}$ is flexed outwardly with finger pressure to place cover $\mathbf{10}^{VII}$ over the lock assembly or to remove cover $\mathbf{10}^{VII}$ from the lock assembly. Material memory flexes the shoulder $\mathbf{14}^{VII}$ back to the unstressed, unflexed position. The circumference of the bottom opening defined by inner face $\mathbf{18}^{VII}$ is dimensioned to be slightly smaller than the circumference of the exposed surfaces of the lock assembly so a tight friction fit is achieved when the cover is secured over the lock assembly Referring now to FIGS. 14 and 15, in a further aspect of the disclosure, a key slot cover shown designated generally as $\mathbf{10}^{VIII}$ may have the same features as the embodiments shown in FIGS. 1-12 or any combination of the features shown in FIGS. 1-12 with the addition of a key hole slot 34. Keyhole slot cover $\mathbf{10}^{VIII}$ includes a flat or ovoid-shaped top surface $\mathbf{12}^{VIII}$ and an annular shoulder $\mathbf{14}^{VIII}$ extending from an inner face of the top surface $\mathbf{12}^{VIII}$. The combination of a bottom face $\mathbf{16}^{VIII}$ of the top surface and an inner surface $\mathbf{18}^{VIII}$ of the annular shoulder $\mathbf{14}^{VIII}$ forms a cavity $\mathbf{20}^{VIII}$ dimensioned to receive the exposed surfaces of a vehicle lock assembly including a keyhole slot found particularly in late model Jeep® brand vehicles.

Top surface 12$^{VIII}$ is formed with key hole slot 34 to permit ready access to the underlying key hole slot in the lock assembly to which cover 10$^{VIII}$ releasably attached. In the embodiment shown in FIG. 14, slot 34 remains open. In the embodiment shown in FIG. 15, a hinged slot cover 46 biased on the closed position, keeps slot 34 closed until a key is inserted into the slot that pushes slot cover 46 away. The hinge may be a formal hinge with eyelets and a pin as is commonly known in the art, or may result from the inherent flexibility of the material used to form slot cover 46 such as rubber in which a section of the slot cover 46 is secured to the bottom surface 16$^{VIII}$ and the remainder is free floating over the slot 34.

The vehicle key slot cover of claim 1 wherein the shoulder is formed with a taper in cross-section.

It should be understood slot 34 can conform to any regular or irregular geometric shape such as a circle or an oval and remain within the scope and spirit of the disclosure and the appended claims. Like all the prior embodiments, shoulder 14$^{VIII}$ can be flexed outwardly with finger pressure. Material memory flexes the shoulder back to the unstressed, unflexed position. The circumference of the bottom opening defined by inner face 18$^{VIII}$ is dimensioned to be slightly smaller than the circumference of the exposed surfaces of the lock assembly so a tight friction fit is achieved when cover 10$^{VIII}$ is secured over the lock assembly.

Figure 16:
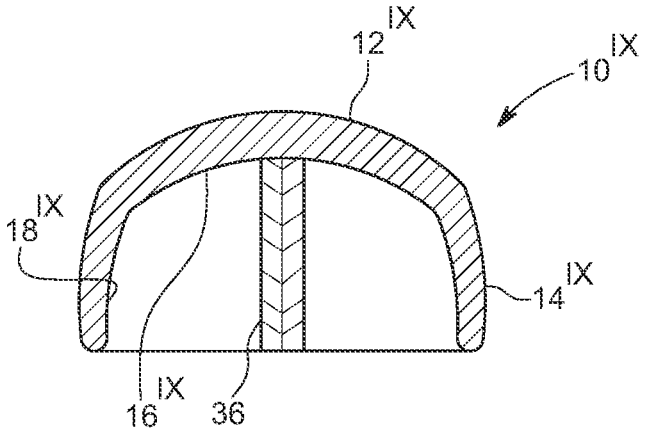
FIG. 16 is a side, sectional view in elevation of a keyhole cover with a v-groove formed in a shoulder according to a yet further embodiment of the disclosure.
Figure 17:
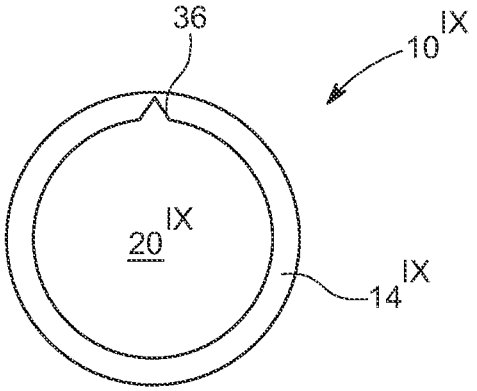
FIG. 17 is a bottom view of the keyhole cover shown in FIG. 16.

Referring now to FIGS. 16 and 17, in yet another aspect of the disclosure, a key slot cover shown designated generally as 10$^{IX}$, includes a flat or ovoid-shaped top surface 12$^{IX}$ and an annular shoulder 14$^{IX}$ extending from an inner face of the top surface 12$^{IX}$. The combination of a bottom face 16$^{IX}$ of the top surface and an inner surface 18$^{IX}$ of the annular shoulder 14$^{IX}$ forms a cavity 20$^{IX}$ dimensioned to receive the exposed surfaces of a vehicle lock assembly including a keyhole slot found particularly in late model Jeep brand vehicles. Annular shoulder 14$^{IX}$ is formed with a v-groove 36 to provide a structural weakened zone and flexion point for shoulder 14$^{IX}$. Application of pressure on shoulder 14$^{IX}$ at v-groove 36 will distort the v-groove along its seam and permit the flexion of shoulder 14$^{IX}$ outwardly. Material memory flexes the shoulder back to the unstressed, unflexed position and the return of the v-groove 36 to its original shape. The circumference of the bottom opening defined by inner face 18$^{IX}$ is dimensioned to be slightly smaller than the circumference of the exposed surfaces of the lock assembly so a tight friction fit is achieved when the cover is secured over the lock assembly.

Figure 18:
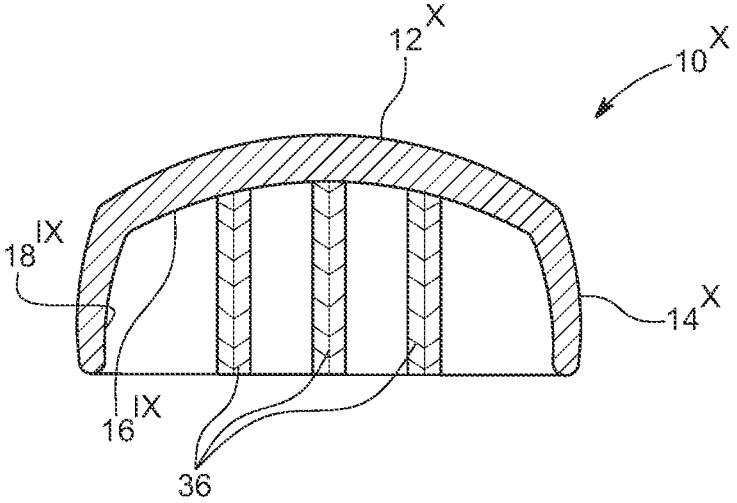
FIG. 18 is a side, sectional view in elevation of a keyhole cover with three v-grooves formed in a shoulder according to a still further embodiment of the disclosure.
Figure 19:
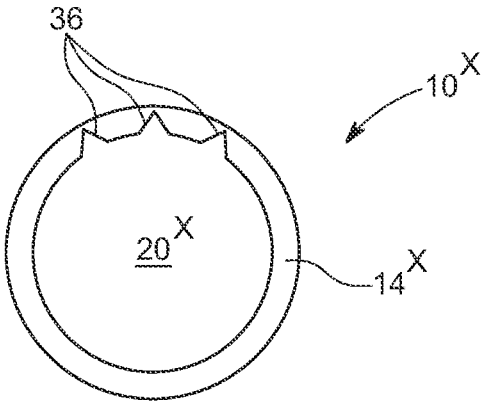
FIG. 19 is a bottom view of the keyhole cover shown in FIG. 18.
Figure 20:
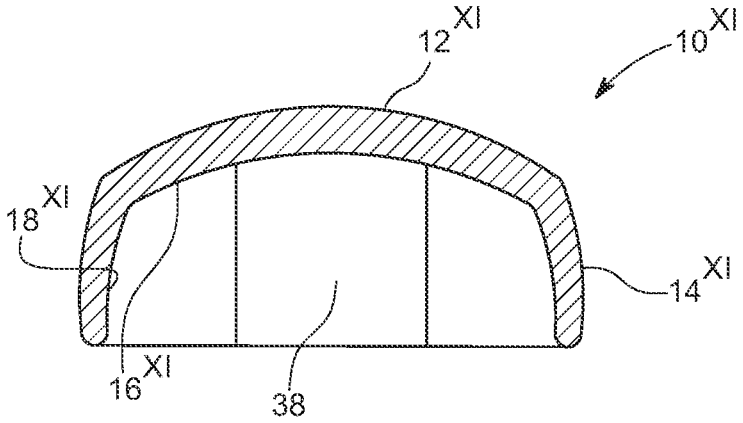
FIG. 20 is a side, sectional view in elevation of a keyhole cover with an elastomeric insert set in a shoulder according to yet another embodiment of the disclosure.
Figure 21:
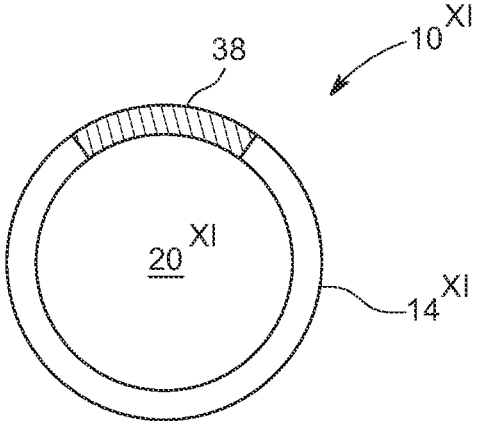
FIG. 21 is a bottom view of the keyhole cover shown in FIG. 20.
Figure 22:
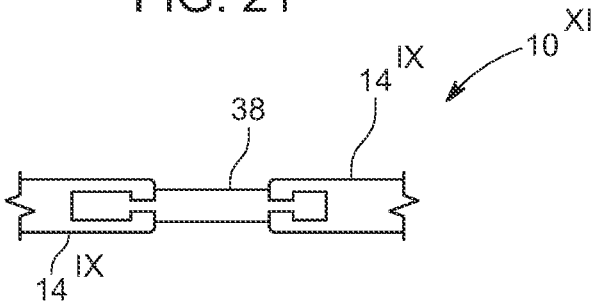
FIG. 22 is bottom, sectional view of the elastomeric insert secured to the shoulder of the keyhole cover shown in FIG. 20.
Figure 22A:
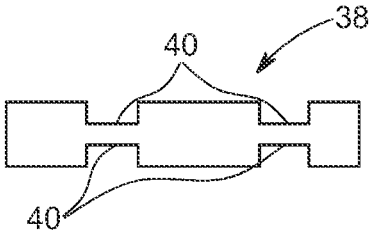
FIG. 22*a* is a sectional, top view of the elastomeric insert and shoulder subassembly shown in FIG. 22.

Referring now to FIGS. 18 and 19, a key slot cover shown designated generally as 10$^{X}$ has all the same features as the embodiment shown in FIGS. 16 and 17 with the addition of a plurality of v-grooves 36. A key slot cover shown designated generally as 10$^{X}$, includes a flat or ovoid-shaped top surface 12$^{X}$ and an annular shoulder 14$^{X}$ extending from an inner face of the top surface 12$^{X}$. The combination of a bottom face 16$^{X}$ of the top surface and an inner surface 18$^{X}$ of the annular shoulder 14$^{X}$ forms a cavity 20$^{X}$ dimensioned to receive the exposed surfaces of a vehicle lock assembly including a keyhole slot found particularly in late model Jeep brand vehicles. Annular shoulder 14$^{X}$ is formed with the plurality of v-grooves 36 to provide an expanded structural weakened zone and flexion area for shoulder 14$^{X}$. Application of pressure on shoulder 14$^{X}$ at v-grooves 36 will distort the v-grooves along their seams and permit a larger range of flexion of shoulder 14$^{X}$ outwardly compared to range of flexion achievable with the embodiment shown in FIGS. 16 and 17. Material memory flexes the shoulder back to the unstressed, unflexed position and the return of the v-grooves 36 to their original shape. The circumference of the bottom opening defined by inner face 18$^{X}$ is dimensioned to be slightly smaller than the circumference of the exposed surfaces of the lock assembly so a tight friction fit is achieved when the cover is secured over the lock assembly.

Referring now to FIGS. 20-22*a*, in a still further aspect of the disclosure, a key slot cover shown designated generally as 10$^{XI}$, includes a flat or ovoid-shaped top surface 12$^{XI}$ and a partial annular shoulder 14$^{XI}$ extending from an inner face of the top surface 12$^{XI}$. The combination of a bottom face 16$^{XI}$ of the top surface and an inner surface 18$^{XI}$ of the partial annular shoulder 14$^{XI}$ forms a partial cavity 20$^{XI}$ dimensioned to receive the exposed surfaces of a vehicle lock assembly including a keyhole slot found particularly in late model Jeep® brand vehicles, particularly the Jeep Wrangler model. A gap in the partial annular shoulder 14$^{XI}$ is filled in by an elastomeric insert 38 to provide an elastic expansion zone that permits shoulder 14$^{XI}$ to be stretched about the circumferential edge of a vehicle lock assembly. Elastomeric insert 38 may be formed with a plurality of insert channels 40 to permit the insert to be secured to shoulder 14$^{XI}$. To secure insert 38 to shoulder 14$^{XI}$, the material used to make shoulder 14$^{XI}$ is heated so as to flow over and into channels 40 to form a mechanical lock between shoulder 14$^{XI}$ and insert 30 when the shoulder material cools and solidifies. Materials that may be used to form the elastomeric insert can be any butadiene-based elastomer, rubber-based materials, neoprene and the like as is known in the art. The material used to form the shoulder and key slot cover may be any deformable thermoplastic material such as polyethylene.

Application of pressure on shoulder 14$^{XI}$ at insert 38 will stretch the insert and permit the flexion of shoulder 14$^{XI}$ outwardly. Material memory of both shoulder 14$^{XI}$ and insert 38 flexes the shoulder back to the unstressed, unflexed position and the return of insert 38 to its original shape. The circumference of the bottom opening defined by inner face 18$^{XI}$ is dimensioned to be slightly smaller than the circumference of the exposed surfaces of the lock assembly so a tight friction fit is achieved when the cover is secured over the lock assembly.

Figure 23:
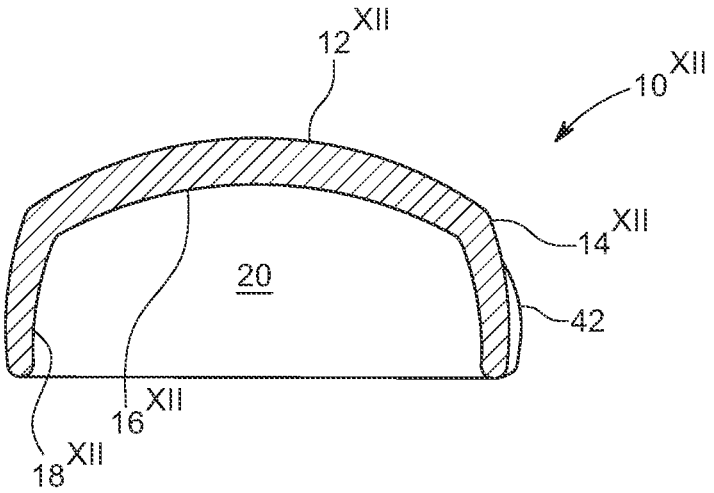
FIG. 23 is a side, sectional view in elevation of a keyhole cover with a thumb tab according to a further embodiment of the disclosure.
Figure 24:
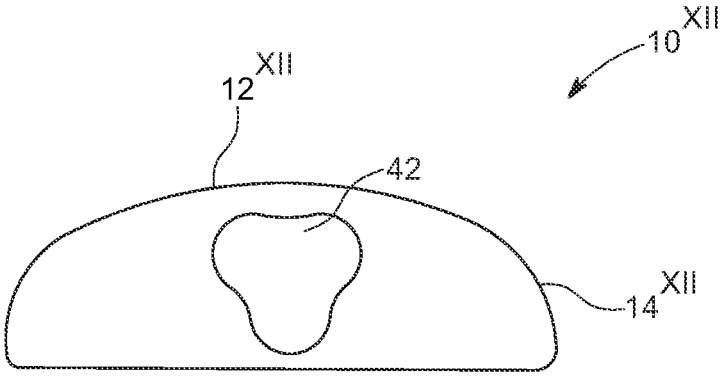
FIG. 24 is a side view in elevation of the keyhole cover with thumb tab shown in FIG. 23.

Referring now to FIGS. 23 and 24, in another aspect of the disclosure, a key slot cover shown designated generally as 10$^{XII}$ includes a flat or ovoid-shaped top surface 12$^{XII}$ and an annular shoulder 10$^{VII}$ extending from an inner face of the top surface 12$^{XII}$. The combination of a bottom face 16$^{XII}$ of the top surface and an inner surface 18$^{XII}$ of the annular shoulder 14$^{XII}$ forms a cavity 20$^{XII}$ dimensioned to receive the exposed surfaces of a vehicle lock assembly including a keyhole slot found particularly in late model Jeep brand vehicles. Annular shoulder 14$^{XII}$ is formed with an external thumb grip 42 to provide a grasping surface to facilitate removal of cover 10$^{XII}$ from a lock assembly. This feature can be incorporated into any of the embodiments disclosed herein.

Thumb grip 42 may be modular and formed as an attachment attached via an adhesive or heat melted onto shoulder 14$^{XII}$ or may be integral with shoulder 14$^{XII}$. The application of an upward pressure on thumb grip with a thumb or finger with exert a releasing pressure on the cover to urge it off the lock assembly. The force will cause flexion of shoulder 14$^{XII}$ outwardly. Material memory flexes the shoulder back to the unstressed, unflexed position after removal from the lock assembly. Like all the other embodiments, the circumference of the bottom opening defined by inner face 18$^{XII}$ is dimensioned to be slightly smaller than the circumference of the exposed surfaces of the lock assembly so a tight friction fit is achieved when the cover is secured over the lock assembly.

Figure 25:
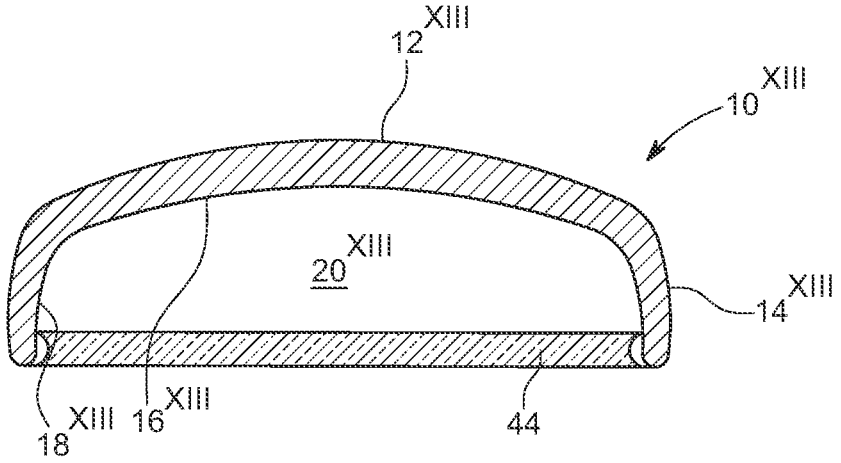
FIG. 25 is a side, sectional view in elevation of a keyhole cover with an annular elastomeric insert secured to a bottom edge of an inner wall of an annular shoulder according to a yet further embodiment of the disclosure.

Referring now to FIG. 25, in a yet further aspect of the disclosure, a key slot cover shown designated generally as $\mathbf{10}^{XIII}$, includes a flat or ovoid-shaped top surface $\mathbf{12}^{XIII}$ and an annular shoulder $\mathbf{14}^{XIII}$ extending from an inner face of the top surface $\mathbf{12}^{XIII}$ The combination of a bottom face $\mathbf{16}^{XIII}$ of the top surface and an inner surface $\mathbf{18}^{XIII}$ of the annular shoulder $\mathbf{14}^{XIII}$ forms a cavity $\mathbf{20}^{XIII}$ dimensioned to receive the exposed surfaces of a vehicle lock assembly including a keyhole slot found particularly in late model Jeep® brand vehicles. Secured to a distal edge of inner surface $\mathbf{18}^{XIII}$ is an annular elastomeric ring 44 that exhibits surface adhesion properties such as silicon. Ring 44 provides additional friction and adhesion with the registration surfaces of the lock assembly to ensure a secure fit. Ring 44 may be secured directly to surface $\mathbf{18}^{XIII}$ or may be inset into an annular channel (not shown) formed in the distal edge of inner surface $\mathbf{18}^{XIII}$.

Application of pressure on shoulder $\mathbf{14}^{XIII}$ is still applied to cause flexion of the shoulder over the lock assembly. This will facilitate ring 44 to slide over the lock assembly. Material memory flexes the shoulder back to the unstressed, unflexed position and places pressure against ring 44, which will, in turn, urge ring 44 against the registration surfaces of the lock assembly. The natural adhesive qualities of the ring 44 material will enhance the registration force without eliminating the ability to disengage cover $\mathbf{10}^{XIII}$ from lock assembly. The circumference of the bottom opening defined by inner face $\mathbf{18}^{XIII}$ in combination with ring 44 is dimensioned to be slightly smaller than the circumference of the exposed surfaces of the lock assembly so a tight friction fit is achieved when the cover is secured over the lock assembly.

Figure 26:
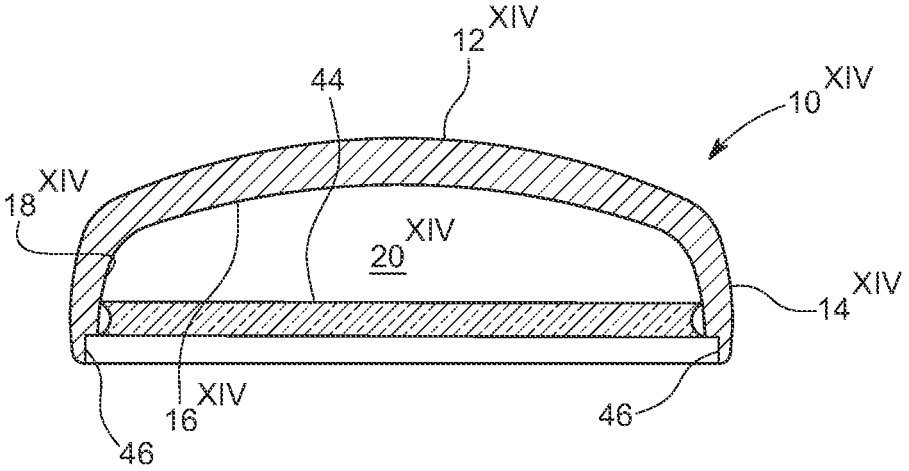
FIG. 26 is a side, sectional view in elevation of a keyhole cover with an annular channel formed on a bottom edge of an inner wall of an annular shoulder and an annular elastomeric insert secured to the inner wall of the annular shoulder adjacent the channel according to a still further embodiment of the disclosure.

Referring now to FIG. 26, a key slot cover shown designated generally as includes a flat or ovoid-shaped top surface $\mathbf{12}^{XIV}$ and an annular shoulder $\mathbf{14}^{XIV}$ extending from an inner face of the top surface $\mathbf{12}^{XIV}$. The combination of a bottom face $\mathbf{16}^{XIV}$ of the top surface and an inner surface $\mathbf{18}^{XIV}$ of the annular shoulder $\mathbf{14}^{XIV}$ forms a cavity $\mathbf{20}^{XIV}$ dimensioned to receive the exposed surfaces of a vehicle lock assembly including a keyhole slot found particularly in late model Jeep® brand vehicles. Formed on a distal edge of inner surface $\mathbf{18}^{XIV}$ is an annular channel 46 dimensioned to accommodate the presence of an elastomeric gasket positioned between a vehicle door and the exposed portions of a lock assembly. The gasket has a diameter greater than the diameter of the lock assembly and is used to create a fluid-tight seal between the door and the lock assembly. Channel 46 accounts for the relatively larger diameter of the gasket so that the gasket does not interfere with the registration of cover $\mathbf{10}^{XIV}$ to the lock assembly. Secured adjacent to channel 46 on inner surface $\mathbf{18}^{XIV}$ is an annular elastomeric ring 44 that exhibits surface adhesion properties such as silicon. Ring 44 provides additional friction and adhesion with the registration surfaces of the lock assembly to ensure a secure fit. Ring 44 may be secured directly to surface $\mathbf{18}^{XIV}$ or may be inset into an annular channel (not shown) formed in the distal edge of inner surface $\mathbf{18}^{XIV}$.

Application of pressure on shoulder $\mathbf{14}^{XIV}$ is still applied to cause flexion of the shoulder over the lock assembly and gasket. This will facilitate ring 44 to slide over the lock assembly. Material memory flexes the shoulder back to the unstressed, unflexed position and places pressure against ring 44, which will, in turn, urge ring 44 against the registration surfaces of the lock assembly. The natural adhesive qualities of the ring 44 material will enhance the registration force without eliminating the ability to disengage cover $\mathbf{10}^{XIV}$ from lock assembly. The circumference of the bottom opening defined by inner face $\mathbf{18}^{XIV}$ in combination with ring 44 is dimensioned to be slightly smaller than the circumference of the exposed surfaces of the lock assembly so a tight friction fit is achieved when the cover is secured over the lock assembly.

The key slot covers disclosed herein may be made from any hard, but flexible material that can withstand the force applied to operate the crackers. Polymers such as polyurethane, polyethylene and butadiene-based elastomers are illustrative examples of the materials that may be used to construct the covers. The materials used to make the covers are disclosed as a matter of illustration and not limitation. Any material that can remain rigid and flex with the application of pressure may be used.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure. What I claim as new and desire to secure by United States Letters Patent is:

I claim:

1. A vehicle key hole cover comprising:

a circular cover having an ovoid or flat surface;

an annular shoulder extending axially from a perimeter of the cover, wherein the shoulder has an inner surface, wherein the annular shoulder and cover define a cavity, and wherein a distal end of the annular shoulder defines an uninterrupted, continuous annular end; and, an annular elastomeric ring secured to the inner surface of the shoulder distal from the junction of the annular shoulder and cover and proximal to the continuous annular end, wherein the combination of the inner surface and the annular elastomeric ring has a circumference dimensioned to be smaller than a circumference of a lock assembly over which the vehicle key hole cover is secured, wherein a radial inner surface of the elastomeric ring registers against the perimeter of a vehicle lock assembly in a side-seal friction fit.

2. The vehicle key hole cover of claim 1 wherein the shoulder is formed with a taper in cross-section.

3. The vehicle key hole cover of claim 1 further comprising an annular channel formed at the distal end of the annular shoulder inner surface, wherein the annular elastomeric ring is positioned adjacent a proximal edge of the annular channel.

4. The vehicle key hole cover of claim 1 further comprising a thumb grip formed on, or secured to an outer surface of the annular shoulder.

5. The vehicle key hole cover of claim 1 further comprising an adhesive patch secured to a bottom surface of the cover.

6. A vehicle key hole cover comprising:

a circular cover having an ovoid or flat surface;

a partial annular shoulder extending axially from a perimeter of the cover, wherein the annular shoulder defines a gap, and wherein the partial annular shoulder has an inner surface; and, an elastomeric shoulder insert secured in the gap of the partial annular shoulder, wherein the combination of the elastomeric shoulder insert and the partial annular shoulder form an annular shoulder having a continuous annular end, wherein the combination of the elastomeric shoulder insert, partial annular shoulder and cover define a cavity, and wherein a radial inner surface of the continuous annular end registers against the perimeter of a vehicle lock assembly in a side-seal friction fit.

7. The vehicle key hole cover of claim 6 wherein the elastomeric insert defines at least one insert channel, wherein material used to form the partial annular shoulder can be heat flowed into the at least one insert channel to mechanically lock the partial annular shoulder to the elastomeric insert when the material cools.

8. The vehicle key hole cover of claim 6 further comprising a thumb grip formed on, or secured to an outer surface of the annular shoulder.

9. The vehicle key hole cover of claim 6 further comprising an adhesive patch secured to a bottom surface of the cover.

10. The vehicle key hole cover of claim 6 further comprising an annular channel formed at the distal end of the partial annular shoulder inner surface.

11. The vehicle key hole cover of claim 6 wherein the shoulder is formed with a taper in cross-section.

12. A vehicle key hole cover comprising:

a circular cover having an ovoid or flat surface;

an annular shoulder extending axially from a perimeter of the cover, wherein a distal end of the annular shoulder forms an uninterrupted, continuous annular end that defines a bottom opening, wherein the shoulder has an inner surface, wherein the inner surface of the annular shoulder and the circular cover define a cavity, and wherein a circumference of the bottom opening defined by the annular shoulder is dimensioned to be smaller than the perimeter of a lock assembly over which the vehicle key hole cover is secured in a side-seal friction fit; and, at least one slot formed in the annular shoulder, wherein the at least one slot does not segment an outer surface of the uninterrupted, continuous end, and wherein the at least one slot reduces a thickness of the annular shoulder.

13. The vehicle key hole cover of claim 12 wherein the at least one slot conforms to any regular or irregular geometric shape.

14. The vehicle key hole cover of claim 12 wherein the at least one slot conforms to the shape of a diamond.

15. The vehicle key hole cover of claim 12 wherein the at least one slot conforms to the shape of a rectangle.

16. The vehicle key hole cover of claim 12 wherein the at least one slot conforms to the shape of a v-groove.

17. The vehicle key hole cover of claim 12 further comprising a plurality of slots.

18. The vehicle key hole cover of claim 12 wherein the shoulder is formed with a taper in cross-section.

19. The vehicle key hole cover of claim 12 wherein the annular shoulder is formed with a series of alternating wall thicknesses with thinner sections alternating with thicker sections.

20. The vehicle key hole cover of claim 12 further comprising a key slot formed in the cover.

* * * * *